US005245800A

United States Patent [19]

Davenport

[11] Patent Number: 5,245,800

[45] Date of Patent: Sep. 21, 1993

[54] GUTTER END CAP

[76] Inventor: Ralph G. Davenport, 900 Forest Haven Dr., Alexandria, Va. 22309

[21] Appl. No.: 828,674

[22] Filed: Jan. 31, 1992

[51] Int. Cl.[5] ..... E04D 13/06

[52] U.S. Cl. ..... 52/11

[58] Field of Search ..... 52/11, 12, 15, 16; D23/267

[56] References Cited

U.S. PATENT DOCUMENTS

D. 230,597 3/1974 Settle .
D. 297,561 9/1988 Leisemann .
4,279,514 7/1981 Bruhn et al. .
4,407,097 10/1983 Allen .

*Primary Examiner*—Michael Safavi
*Attorney, Agent, or Firm*—Shlesinger Arkwright & Garvey

[57] ABSTRACT

An end cap for an ornamental gutter comprising a top, a bottom, a front side, a rear side, an outside end wall, an inside interior wall and an inside end wall. The rear side of the end cap has a substantially smooth vertical surface and is provided with first and second areas. The front side of the end cap has an ornamental configuration corresponding to the ornamental configuration of an attached length of gutter and is also provided with first and second areas. The bottom and the top sides have substantially smooth horizontal surfaces and each are provided with first and second areas. The outside end wall has an ornamental configuration corresponding to the ornamental configuration of an attached length of gutter and is similar to the front side ornamental configuration of the end cap. The inside end wall has a substantially smooth vertical surface and the inside interior wall comprises three substantially vertically extending surfaces which end at the top side and include a bottom surface ending at the inside end wall. The inside interior wall has a surface configuration separate and distinct from the front side and the outside end wall. The end cap top, rear side, front side and bottom second areas rearwardly extend for positioning and securing to the ornamental gutters respective top, rear side, front side and bottom.

14 Claims, 2 Drawing Sheets

GUTTER END CAP

FIELD OF THE INVENTION

This invention relates to an end cap for a rain gutter mounted along and underneath the eaves of a building, and more particularly to an end cap having a configuration conforming to the ornamental configuration of the attached gutter.

BACKGROUND OF THE INVENTION

It is customary in the home construction industry to provide rain gutters for mounting along and underneath the eaves of a building thereby capturing and directing rain runoff from the building's roof to a remote location for drainage.

Normally, the gutters are open-topped and formed from a continuous length of relatively rigid sheet material such as aluminum or galvanized steel. Gutters may also be formed from other materials such as rigid polyvinylchloride or other synthetics. Generally speaking, the gutter has vertically extending front and back walls as well as a substantially flat bottom. The front wall of the gutter is often provided with an ornamental design which extends along its length, thereby contributing to the overall aesthetic appearance of the home.

Since the gutters are mounted underneath the eaves of a building and below the roof, they do not extend the entire periphery of the building and thus terminate at the ends of the roof. As a result, rain gutters require "capping" at these open ends to prevent collected water from improperly draining.

It is customary in the art to cap the open ends of sheet metal type gutters using stamped metal caps which are formed with recesses therein to accept the edges of the open end of the gutter. Normally, this recess is placed over the end of the gutter and driven on until the gutter fully enters the recess. The cap and the gutter are then riveted or crimped together. Illustrative of such devices are shown in U.S. Pat. No. Des. 297,561 (Leisemann).

Other rain gutter end caps are designed to selectively open and close in order to facilitate cleaning of accumulated debris within the gutter. U.S. Pat. No. 4,407,097 (Allen) discloses a gutter end cap having a hinge with latch means to releasibly open and close the end of the gutter for cleaning purposes.

Finally, portions of the gutter often contain ornamental configurations for improving the aesthetic appearance of the gutter itself. U.S. Pat. No. Des. 230,597 (Settle) discloses a head for a gutter downspout having an ornamental casing which is open at the top and bottom to direct fluid through the device and into a separate conduit therebelow.

None of the above mentioned prior art devices provides an end cap for a rain gutter having an ornamental configuration corresponding to the ornamental configuration of the front surface of the attached gutter. In addition, the prior art end caps simply seal off the end of the gutter and in no way assist in directing rain which accumulates within the gutter. End caps which contain the peripheral recess for accepting the end of the gutter are often difficult to align when being assembled onto the ends of the gutter. This problem is compounded when a sealant is incorporated within the recess. Additionally, prior art devices require close tolerances within the gap of the end cap recess so that upon assembly the edge of the gutter end interfits within the recess. End cap constructions which contain a recess also fail to provide a streamlined appearance between the surface of the gutter and the attached end cap.

OBJECTS AND SUMMARY OF THE INVENTION

It is therefore an object of the present invention to provide a decorative gutter end cap having a configuration similar to the overall gutter configuration to which it is attached so as to extend the styling of the gutter around it's end, thereby increasing the overall aesthetic appearance.

An additional object of the present invention is to provide an end cap configuration having a unique interlocking relationship to the end of the gutter thereby resulting in a streamlined end cap lying flush with the exterior surface of the gutter.

Still a further object of the present invention is to provide a gutter end cap which functions to collect rain water and direct it towards the interior of the attached gutter.

A further object of the present invention is to provide a gutter end cap which can be economically manufactured from a variety of materials.

A still further object of the present invention is to provide a gutter end cap which can be easily installed onto the end of a gutter, thereby resulting in savings of both time and expense.

These and other objects of the present invention are realized by providing an end cap for an ornamental gutter comprising a top, a bottom, a front side, a rear side, an outside end wall, an inside interior wall and an inside end wall. The rear side of the end cap has a substantially smooth vertical surface and is provided with first and second areas. The front side of the end cap has an ornamental configuration corresponding to the ornamental configuration of an attached length of gutter and is also provided with first and second areas. The bottom and top sides have substantially smooth horizontal surfaces and each are provided with first and second areas. The outside end wall has an ornamental configuration corresponding to the ornamental configuration of an attached length of gutter and is similar to the front side ornamental configuration of the end cap. The inside end wall has a substantially smooth vertical surface and the inside interior wall comprises three substantially vertically extending surfaces which end at the top side and include a bottom surface ending at the inside end wall. The inside interior wall has a surface configuration separate and distinct from the front side and the outside end wall. The end cap top, rear side, front side and bottom second areas rearwardly extend for positioning and securement to the ornamental gutters respective top, rear side, front side and bottom.

The present invention also provides an ornamental gutter having a matching end cap for mounting along and underneath the eaves of a building and comprising a length of gutter having first and second ends, a top, an ornamental front side, a bottom and a rear side. An end cap is provided having a top, a bottom, a front side, a rear side, an outside end wall and an inside end wall. Both the end cap front side and the end cap outside end wall have ornamental configurations corresponding to the gutter ornamental front side. The end cap top, bottom, front side and rear side are provided with mounting areas for one of the gutter ends. The mounting areas extend rearwardly to the end cap inside end wall.

Additional objects, advantages and features of the present invention will become apparent from a consideration of the following specification taken in conjunction with the accompanying drawings.

DETAILED DESCRIPTION OF THE PREFERRED EMBODIMENT

Figure 1:
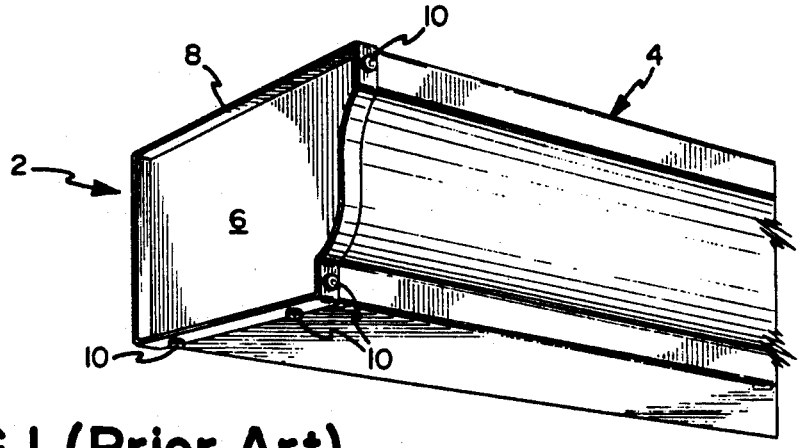
FIG. 1 (Prior Art)
FIG. 1 is a perspective view of a prior art end cap attached to a length of gutter having portions broken away therefrom.

Referring to FIG. 1, a prior art end cap 2 is shown attached to the end of a length of gutter 4. A planar vertical end wall 6 with an associated rim 8 containing a recess (not shown) is interfitted onto the end of the length of gutter 4 and secured by rivets 10.

Figure 2:
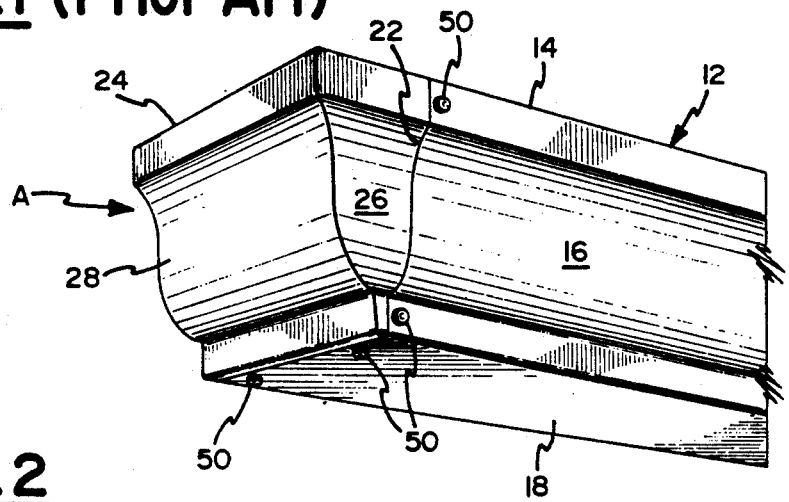
FIG. 2 is a perspective view of the end cap device according to the present invention when attached to a length of gutter having portions broken away therefrom.
Figure 3:
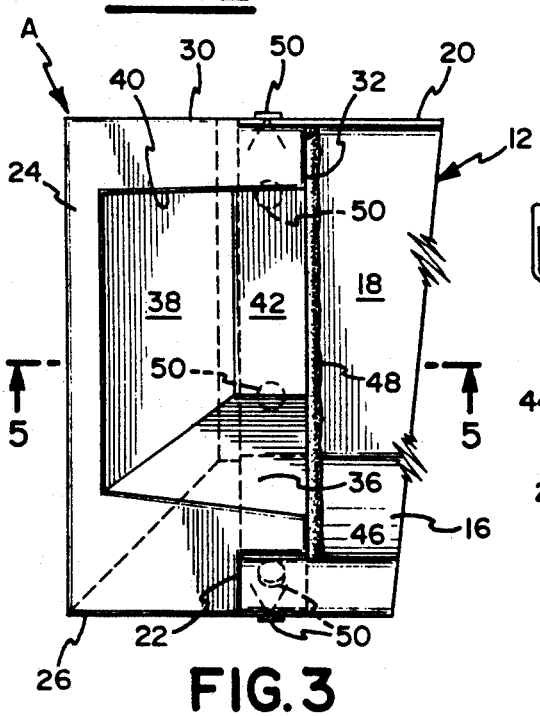
FIG. 3 is a top plan view showing the end cap secured to the end of a length of gutter having portions broken away therefrom.

Turning now to FIGS. 2 and 3, the end cap A according to the present invention is shown attached to a conventional length of gutter 12 comprising a top 14, an ornamental front side 16, a generally planar bottom 18 and a rear side or wall 20. The length of gutter 12 terminates at a first end 22 and at an opposite, second end (not shown).

The end cap A is provided with a top 24 having a substantially smooth horizontal surface co-planar with the top 14 of the length of gutter 12. The end cap A also includes a front side 26 having an ornamental configuration corresponding to the ornamental configuration of the gutter front side 16.

As best shown in FIG. 2, an outside end wall 28 includes an ornamental configuration corresponding to the ornamental configuration of the gutter front side 16. This matching configuration of outside end wall 28 to the front side 16 provides an angled or sloping exterior surface to the outside end wall 28. A rear side 30 is positioned opposite the front side 26 and has a generally planar vertical surface matching the rear wall 20 of the length to gutter 12.

Figure 4:
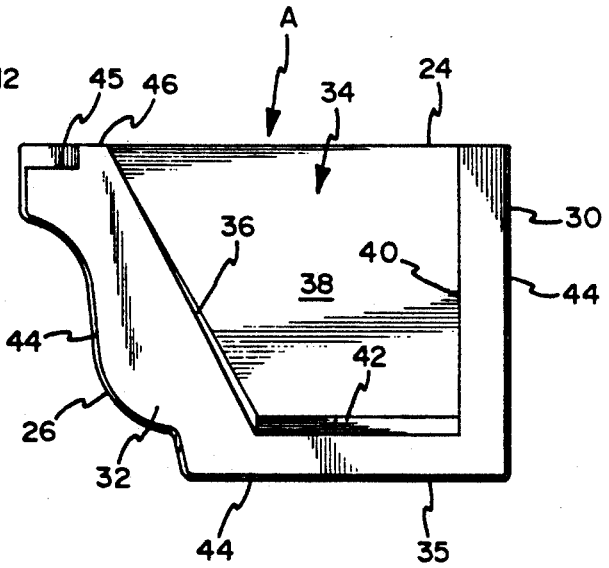
FIG. 4 is a side view of the end cap device of FIG. 2 showing the inside end wall.

As best shown in FIG. 4, an inside end wall 32 is positioned opposite the outside end wall 28. The inside end wall 32 has a substantially smooth vertical surface. The interior of the end cap A is defined by an inside interior wall 34 comprising three substantially vertically extending surfaces 36, 38 and 40 terminating at their upper ends near the end cap top 24 and at their lower ends adjacent bottom 42.

As best shown in FIGS. 3 and 4, vertically extending surface 38 and vertically extending surface 36 are disposed at an angle set about 60° from the horizontal. The remaining vertically extending surface 40 is shown containing no such slope and is disposed substantially perpendicular to the horizontal plane of the end cap A. The bottom surface 42 is provided with a downwardly extending slope and extends from the vertically extending surface 38 to the inside end wall 32. The overall effect of this arrangement is that rain water collected within the end cap is directed into the main passageway of the gutter 12 thereby aiding with transport of such collected fluid.

Figure 5:
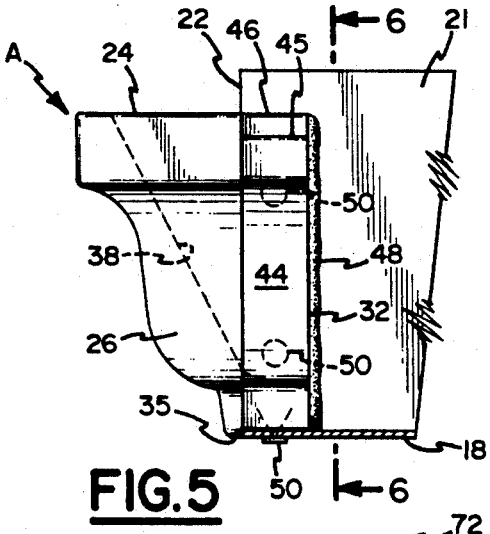
FIG. 5 is a cross sectional view taken along lines 5—5 of FIG. 3 showing the end cap attached to a length of gutter having portions broken away therefrom.

Turning now to FIGS. 4 and 5, a peripheral recess or mounting area 44 is shown extending the perimeter of the end cap A and adjacent the inside end wall 32 and into the top 24, front side 26, bottom 35 and rear side 30. The peripheral recess or mounting area 44 generally extends into the surface of the end cap A a depth of about 1/16 of an inch. However, the segment of the peripheral recess 44 within the top 24 has a greater depth in order to accommodate the top 14 of the length of gutter 12. A preferred depth for the portion of recess 44 within top 24 is about ⅛ of an inch. Of course, this amount may vary with the selected size of the length of gutter 12. The overall requirement is that when end cap A is attached to the gutter 12, the top 14 of the length of gutter 12 and the top 24 of the end cap A lie mutually flush and thereby provide a continuous and smooth overall appearance.

The top 24 of the end cap A also contains a raised abutment 46 which is bordered by the upper portion of the vertically extending surface 36 and the upper end of the inside end wall 32. In a preferred embodiment, the raised abutment 46 has a width such that when the end cap A is attached to a length of gutter 12, the top 14 of the gutter 12 lies adjacent to and flush with the raised abutment 46.

Figure 6:
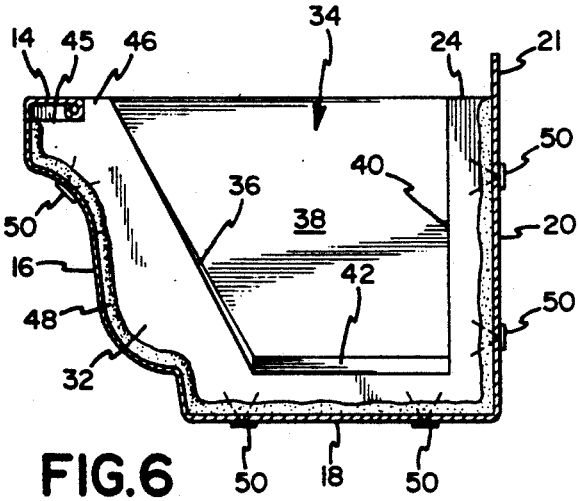
FIG. 6 is a cross sectional view taken along lines 6—6 of FIG. 5 showing the end cap attached to a length of gutter.

Turning now to FIGS. 3, 5 and 6 the end cap A is shown secured to a length of gutter 12. A sealant or adhesive 48 is coated or otherwise deposited within the peripheral recess 44 of the end cap A prior to assembly with the length of gutter 12. In a preferred embodiment, sufficient sealant or adhesive 48 is applied so that when the first end 22 of the length of gutter 12 is interfit within the peripheral recess 44, excess sealant or adhesive 48 is forced out to provide a bead seal or gasket along the interior perimeter of the length of gutter 12. Generally speaking, the end cap A and the first end 22 of the length of gutter 12 are interfit so that the exterior surface of the length of gutter 12 and the end cap A lie flush and thereby provide a continuous and smooth overall appearance.

Additional securing means 50 are provided by rivets 50 or other means to firmly join the end cap A to the first end 22 of the length of gutter 12. Rivets are a preferred means of attachment when the construction of the gutter 12 is anodized aluminum or other sheet metal. Thus, the adhesive 48 serves primarily to create a water-tight seal between the end cap A and the length of gutter 12 while the securing means or rivets 50 act as a primary connection means therebetween.

Figure 7:
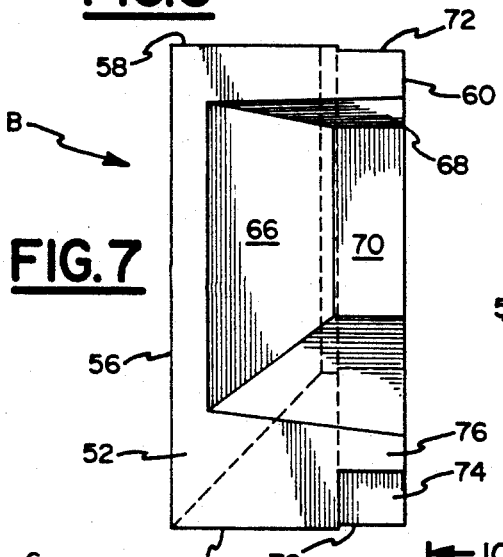
FIG. 7 is a top plan view showing an alternative arrangement of the end cap according to the present invention.
Figure 8:
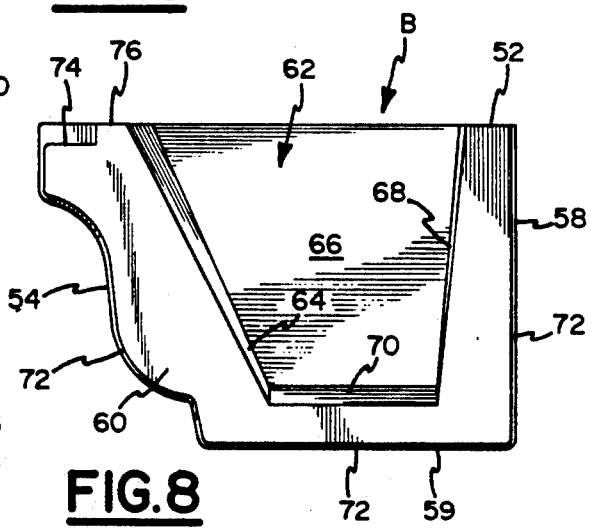
FIG. 8 is a side view of the end cap of FIG. 7 showing the inside end wall.

Turning now to FIGS. 7 and 8, an alternative arrangement of the present invention is shown whereby an end cap B is provided and includes top 52, a front side 54, an outside end wall 56, a rear side 58, a bottom 59 and an inside end wall 60. A peripheral recess or mounting area 72 is disposed within the perimeter surface of the end cap B adjacent the inside end wall 60. The peripheral recess or mounting area 44 generally extends into the surface of the end cap A a depth of about 1/16 of an inch. The portion of the peripheral recess or mounting area 72 disposed within top 52 includes a ledge portion 74 and a raised abutment 76. A preferred depth for recess 72 within the top 52 is about ⅛ of an inch. It is within the scope of the present invention to vary the depth of recess 72 in proportion to the gauge of the gutter selected for attachment.

The inside interior wall 62 contains three vertically extending surface 64, 66 and 68, each of which is angularly disposed towards a sloping bottom surface 70. The angle of the slope is about 60° from the horizontal. The overall effect of this arrangement is that water which collects within the interior of the end cap B is efficiently directed towards the interior of the attached length of gutter (not shown) while still retaining the unique aesthetic features of the end cap B.

Figure 9:
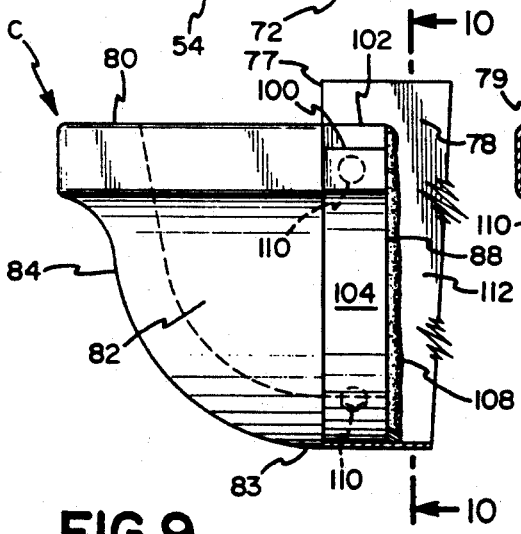
FIG. 9 is another alternative arrangement of the end cap according to the present invention shown in cross-section and including an attached length of gutter with portions broken away therefrom.
Figure 10:
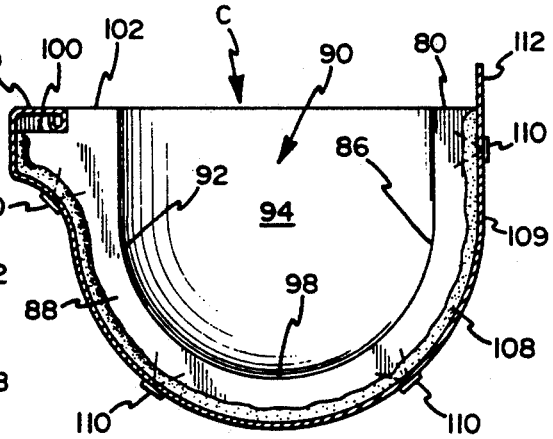
FIG. 10 is a cross sectional view of the end cap shown in FIG. 9 taken along lines 10—10.

Turning now to FIGS. 9 and 10, yet another alternative arrangement of the present invention is shown whereby an end cap C is provided in conjunction with an attached length of gutter 78. The end cap C has a generally arcuate or curved ornamental exterior surface to match the ornamental surface of the length of gutter 78. The end cap C contains a planar top 80, a front side 82, an outside end wall 84, a rear side 86, an inside end wall 88, a bottom surface 83 and an inside interior wall 90.

The inside interior wall 90 includes three substantially vertically extending surfaces 92, 94 and 96 each of which is coextensive and has a curvature extending along the horizontal plane. The inside interior wall 90 also includes a bottom surface 98 which slopes downwardly from and is coplanar with the three vertically extending surfaces 92, 94 and 86.

The top 80 of the end cap C is provided with a recess portion created by a ledge 100 and which is bordered by a raised abutment 102 disposed within the top 80 and extending between the upper portion of the vertically extending surface 92 and the upper portion of the inside end wall 88. The recess portion has a depth of about ⅛ of an inch but can vary with the thickness of gutter top 80. The top of the gutter 79 interfits within the recess created by the ledge 100 of the end cap C. The surface of the top of the gutter 79 is co-planar with the surface of the top 80 of the end cap C.

A peripheral recess or mounting area 104 extends along the perimeter of the end cap top 80, front side 82, bottom surface 83 and rear side 86 which lie adjacent the inside end wall 88. The recess 104 generally extends a depth of about 1/16 of an inch into the end cap C. The recess portion within the top 80 comprises a portion of the peripheral recess 104. Recess 104 can of course vary in depth depending upon the gauge of the gutter 78. The only requirement according to the present invention is that the peripheral recess 104 be of a sufficient depth so as to provide a flush surface extending between the end of the length of gutter 78 and the end cap C.

In use, a first end 77 of the length of gutter 78 is positioned within the peripheral recess or mounting area 104 with an adhesive or sealant 108 disposed therebetween. As best shown in FIG. 10, sufficient adhesive or sealant 108 is applied so that an excessive amount forms a bead or seal within the interior of the gutter 78. Any excessive adhesive or sealant 108 is then removed from the exterior of the end cap C or gutter 78.

A number of rivets or other securing means 110 are also provided to mechanically secure the end cap C to the first end 77 of the length of gutter 78. The rivets 110 may be applied to the exterior of the first end 77 of length of gutter 78 once it is positioned within the peripheral recess or mounting area 104. A splash plate 112 extends from the rear surface 109 of the length of gutter 78 and above the top 80 of end cap C.

While this invention has been described as having a preferred design, it is understood that it is capable of further modifications, uses and/or adaptions of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

I claim:

1. An end cap for an ornamental gutter comprising:

a) a top, a bottom, a front side, a rear side, an outside end wall, an inside interior wall and an inside end wall;

b) said rear side having a substantially smooth vertical surface and having first and second areas;

c) said front side having an ornamental configuration corresponding to the ornamental configuration of an attached gutter;

d) said front side having first and second areas;

e) said bottom having a substantially smooth horizontal surface and having first and second areas;

f) said top side having a substantially smooth horizontal surface and having first and second areas;

g) said outside end wall having an ornamental configuration corresponding to the ornamental configuration of an attached gutter and similar to said front side ornamental configuration;

h) said inside end wall having a substantially smooth vertical surface;

i) said inside interior wall comprising three substantially vertically extending surfaces ending at said top side and including a bottom surface ending at said inside end wall;

j) said inside interior wall having a surface configuration separate and distinct from said front side and said outside end wall;

k) said top, said rear side, said front side and said bottom second areas rearwardly extending for positioning and securing to the ornamental gutter's respective top, rear side, front side and bottom; and l) said bottom surface comprising a planar, downwardly sloping surface.

2. An end cap for an ornamental gutter comprising:

a) a top, a bottom, a front side, a rear side, an outside end wall, an inside interior wall and an inside end wall;

b) said rear side having a substantially smooth vertical surface and having first and second areas;

c) said front side having an ornamental configuration corresponding to the ornamental configuration of an attached gutter;

d) said front side having first and second areas;

e) said bottom having a substantially smooth horizontal surface and having first and second areas;
f) said top side having a substantially smooth horizontal surface and having first and second areas;
g) said outside end wall having an ornamental configuration corresponding to the ornamental configuration of an attached gutter and similar to said front side ornamental configuration;
h) said inside end wall having a substantially smooth vertical surface;
i) said inside interior wall comprising three substantially vertically extending surfaces ending at said top side and including a bottom surface ending at said inside end wall;
j) said inside interior wall having a surface configuration separate and distinct from said front side and said outside end wall;
k) said top, said rear side, said front side and said bottom second areas rearwardly extending for positioning and securing to the ornamental gutter's respective top, rear side, front side and bottom;
l) said top, said bottom and said front side second area's including a continuous recess for interfit with and securement to the ornamental gutters respective top, bottom and front side; and
m) said top second area recess including a raised abutment coplanar with and extending from said top first area to said inside end wall.

3. An end cap for an ornamental gutter comprising:
a) a top, a bottom, a front side, a rear side, an outside end wall, an inside interior wall and an inside end wall;
b) said rear side having a substantially smooth vertical surface and having first and second areas;
c) said front side having an ornamental configuration corresponding to the ornamental configuration of an attached gutter;
d) said front side having first and second areas;
e) said bottom having a substantially smooth horizontal surface and having first and second areas;
f) said top side having a substantially smooth horizontal surface and having first and second areas;
g) said outside end wall having an ornamental configuration corresponding to the ornamental configuration of an attached gutter and similar to said front side ornamental configuration;
h) said inside end wall having a substantially smooth vertical surface;
i) said inside interior wall comprising three substantially vertically extending surfaces ending at said top side and including a bottom surface ending at said inside end wall;
j) said inside interior wall having a surface configuration separate and distinct from said front side and said outside end wall;
k) said top, said rear side, said front side and said bottom second areas rearwardly extending for positioning and securing to the ornamental gutter's respective top, rear side, front side and bottom;
l) said top, said bottom, said front side and said rear side second area's including a continuous recess for interfit with and securement to the ornamental gutters respective top, bottom, front side and rear side; and
m) said top second area recess including a raised abutment coplanar with and extending from said top first area to said inside end wall.

4. An end cap for an ornamental gutter comprising:
a) a top, a bottom, a front side, a rear side, an outside end wall, an inside interior wall and an inside end wall;
b) said rear side having a substantially smooth vertical surface and having first and second areas;
c) said front side having an ornamental configuration corresponding to the ornamental configuration of an attached gutter;
d) said front side having first and second areas;
e) said bottom having a substantially smooth horizontal surface and having first and second areas;
f) said top side having a substantially smooth horizontal surface and having first and second areas;
g) said outside end wall having an ornamental configuration corresponding to the ornamental configuration of an attached gutter and similar to said front side ornamental configuration;
h) said inside end wall having a substantially smooth vertical surface;
i) said inside interior wall comprising three substantially vertically extending surfaces ending at said top side and including a bottom surface ending at said inside end wall;
j) said inside interior wall having a surface configuration separate and distinct from said front side and said outside end wall;
k) said top, said rear side, said front side and said bottom second areas rearwardly extending for positioning and securing to the ornamental gutter's respective top, rear side, front side and bottom; and
l) said three substantially vertically extending surfaces have a curvature and are uniformly coextensive with respect to each other.

5. An ornamental gutter provided with a matching end cap mounted along and underneath the eaves of a building comprising:
a) a length of gutter having first and second ends, a top, an ornamental front side, a bottom and a rear side;
b) an end cap having a top, a bottom, a front side, a rear side, an outside end wall and an inside end wall;
c) said end cap front side having an ornamental configuration corresponding to said gutter ornamental front side;
d) said end cap outside end wall having an ornamental configuration corresponding to said gutter ornamental front side;
e) said end cap top, said bottom, said front side and said rear side provided with mounting areas for one of said gutter ends, said areas extending rearwardly to said end cap inside end wall;
f) one of said gutter ends mounted to said end cap with said end cap top, said bottom, said front side and said rear side mounting areas secured to said gutter's respective top, said ornamental front side, said bottom and said rear side;
g) an inside interior wall including at least three substantially vertically extending surfaces ending at said top side and including a bottom surface ending at said inside end wall;
h) said inside interior wall having a surface configuration separate and distinct from said front side and said outside end wall; and
i) two of said three substantially vertically extending surfaces comprising intersecting, sloping planar walls.

6. An ornamental gutter as in claim 5 and further comprising:

a) a splash plate co-extensive with said length of gutter and said rear side and projecting from said rear side a distance above said end cap top.

7. An ornamental gutter provided with a matching end cap mounted along and underneath the eaves of a building comprising:

a) a length of gutter having first and second ends, a top, an ornamental front side, a bottom and a rear side;

b) an end cap having a top, a bottom, a front side, a rear side, an outside end wall and an inside end wall;

c) said end cap front side having an ornamental configuration corresponding to said gutter ornamental front side;

d) said end cap outside end wall having an ornamental configuration corresponding to said gutter ornamental front side;

e) said end cap top, said bottom, said front side and said rear side provided with mounting areas for one of said gutter ends, said areas extending rearwardly to said end cap inside end wall;

f) one of said gutter ends mounted to said end cap with said end cap top, said bottom, said front side and said rear side mounting areas secured to said gutter's respective top, said ornamental front side, said bottom and said rear side;

g) an inside interior wall including at least three substantially vertically extending surfaces ending at said top side and including a bottom surface ending at said inside end wall;

h) said inside interior wall having a surface configuration separate and distinct from said front side and said outside end wall; and i) said bottom surface comprising a downwardly sloping planar surface.

8. An ornamental gutter provided with a matching end cap mounted along and underneath the eaves of a building comprising:

a) a length of gutter having first and second ends, a top, an ornamental front side, a bottom and a rear side;

b) an end cap having a top, a bottom, a front side, a rear side, an outside end wall and an inside end wall;

c) said end cap front side having an ornamental configuration corresponding to said gutter ornamental front side;

d) said end cap outside end wall having an ornamental configuration corresponding to said gutter ornamental front side;

e) said end cap top, said bottom, said front side and said rear side provided with mounting areas for one of said gutter ends, said areas extending rearwardly to said end cap inside end wall;

f) one of said gutter ends mounted to said end cap with said end cap top, said bottom, said front side and said rear side mounting areas secured to said gutter's respective top, said ornamental front side, said bottom and said rear side;

g) said end cap top, said bottom and said front side mounting areas provided with a rearwardly extending continuous recess for interfit with and securement to said gutters respective top, bottom and ornamental front side; and h) said top mounting area recess including a raised abutment coplanar with said top and extending the width of said recess to said inside end wall.

9. An ornamental gutter provided with a matching end cap mounted along and underneath the eaves of a building comprising:

a) a length of gutter having first and second ends, a top, an ornamental front side, a bottom and a rear side;

b) an end cap having a top, a bottom, a front side, a rear side, an outside end wall and an inside end wall;

c) said end cap front side having an ornamental configuration corresponding to said gutter ornamental front side;

d) said end cap outside end wall having an ornamental configuration corresponding to said gutter ornamental front side;

e) said end cap top, said bottom, said front side and said rear side provided with mounting areas for one of said gutter ends, said areas extending rearwardly to said end cap inside end wall;

f) one of said gutter ends mounted to said end cap with said end cap top, said bottom, said front side and said rear side mounting areas secured to said gutter's respective top, said ornamental front side, said bottom and said rear side;

g) said end cap top, said bottom, said front side and said rear side provided with a rearwardly extending continuous recess for interfit with and securement to said gutters respective top, bottom, ornamental front side and rear side; and h) said top mounting area recess including a raised abutment coplanar with said top and extending the width of said recess to said inside end wall.

10. An ornamental gutter provided with a matching end cap mounted along and underneath the eaves of a building comprising:

a) a length of gutter having first and second ends, a top, an ornamental front side, a bottom and a rear side;

b) an end cap having a top, a bottom, a front side, a rear side, an outside end wall and an inside end wall;

c) said end cap front side having an ornamental configuration corresponding to said gutter ornamental front side;

d) said end cap outside end wall having an ornamental configuration corresponding to said gutter ornamental front side;

e) said end cap top, said bottom, said front side and said rear side provided with mounting areas for one of said gutter ends, said areas extending rearwardly to said end cap inside end wall;

f) one of said gutter ends mounted to said end cap with said end cap top, said bottom, said front side and said rear side mounting areas secured to said gutter's respective top, said ornamental front side, said bottom and said rear side;

g) an inside interior wall including at least three substantially vertically extending surfaces ending at said top side and including a bottom surface ending at said inside end wall;

h) said inside interior wall having a surface configuration separate and distinct from said front side and said outside end wall; and i) each of said three substantially vertically extending surfaces comprising a sloping planar wall.

11. An ornamental gutter provided with a matching end cap mounted along and underneath the eaves of a building comprising:

a) a length of gutter having first and second ends, a top, an ornamental front side, a bottom and a rear side;

b) an end cap having a top, a bottom, a front side, a rear side, an outside end wall and an inside end wall;

c) said end cap front side having an ornamental configuration corresponding to said gutter ornamental front side;

d) said end cap outside end wall having an ornamental configuration corresponding to said gutter ornamental front side;

e) said end cap top, said bottom, said front side and said rear side provided with mounting areas for one of said gutter ends, said areas extending rearwardly to said end cap inside end wall;

f) one of said gutter ends mounted to said end cap with said end cap top, said bottom, said front side and said rear side mounting areas secured to said gutter's respective top, said ornamental front side, said bottom and said rear side;

g) an inside interior wall including at least three substantially vertically extending surfaces ending at said top side and including a bottom surface ending at said inside end wall;

h) said inside interior wall having a surface configuration separate and distinct from said front side and said outside end wall; and i) said three substantially vertically extending surfaces have a curvature and are uniformly co-extensive with respect to each other.

12. An end cap for an ornamental gutter comprising:

a) a top, a bottom, a front side, a rear side, an outside end wall, an inside interior wall and an inside end wall;

b) said rear side having a substantially smooth vertical surface and having first and second areas;

c) said front side having an ornamental configuration corresponding to the ornamental configuration of an attached gutter;

d) said front side having first and second areas;

e) said bottom having a substantially smooth horizontal surface and having first and second areas;

f) said top side having a substantially smooth horizontal surface and having first and second areas;

g) said outside end wall having an ornamental configuration corresponding to the ornamental configuration of an attached gutter and similar to said front side ornamental configuration;

h) said inside end wall having a substantially smooth vertical surface;

i) said inside interior wall comprising three substantially vertically extending surfaces ending at said top side and including a bottom surface ending at said inside end wall;

j) said inside interior wall having a surface configuration separate and distinct from said front side and said outside end wall;

k) said top, said rear side, said front side and said bottom second areas rearwardly extending for positioning and securing to the ornamental gutter's respective top, rear side, front side and bottom; and l) each of said three substantially vertically extending surfaces comprising a sloping planar wall.

13. An ornamental gutter provided with a matching end cap mounted along and underneath the eaves of a building comprising:

a) a length of gutter having first and second ends, a top, an ornamental front side, a bottom and a rear side;

b) an end cap having a top, a bottom, a front side, a rear side, an outside end wall and an inside end wall;

c) said end cap front side having an ornamental configuration corresponding to said gutter ornamental front side;

d) said end cap outside end wall having an ornamental configuration corresponding to said gutter ornamental front side;

e) said end cap top, said bottom, said front side and said rear side provided with mounting areas for one of said gutter ends, said areas extending rearwardly to said end cap inside end wall;

f) one of said gutter ends mounted to said end cap with said end cap top, said bottom, said front side and said rear side mounting areas secured to said gutter's respective top, said ornamental front side, said bottom and said rear side; and g) rivets for securing said end cap to one of said gutter ends at said mounting area.

14. An ornamental gutter provided with a matching end cap mounted along and underneath the eaves of a building comprising:

a) a length of gutter having first and second ends, a top, an ornamental front side, a bottom and a rear side;

b) an end cap having a top, a bottom, a front side, a rear side, an outside end wall and an inside end wall;

c) said end cap front side having an ornamental configuration corresponding to said gutter ornamental front side;

d) said end cap outside end wall having an ornamental configuration corresponding to said gutter ornamental front side;

e) said end cap top, said bottom, said front side and said rear side provided with mounting areas for one of said gutter ends, said areas extending rearwardly to said end cap inside end wall;

f) one of said gutter ends mounted to said end cap with said end cap top, said bottom, said front side and said rear side mounting areas secured to said gutter's respective top, said ornamental front side, said bottom and said rear side;

g) said mounting area defining a perimeter seal region extending a distance along the point of contact between said end cap mounting area and one of said gutter ends when said gutter end cap is mounted to one of said gutter ends; and h) adhesive seal means positioned within said perimeter seal region, said seal means extending a distance beyond said seal region and within the interior of said ornamental gutter.

* * * * *